United States Patent [19]

Göransson

[11] 4,141,551

[45] Feb. 27, 1979

[54] RACKET

[76] Inventor: Gunnar P. M. Göransson, Folkungagatan 136, S-116 30 Stockholm, Sweden

[21] Appl. No.: 783,599

[22] Filed: Apr. 1, 1977

[30] Foreign Application Priority Data

Apr. 9, 1976 [SE] Sweden ..... 7660418

[51] Int. Cl.[2] ..... A63B 51/00

[52] U.S. Cl. ..... 273/73 G

[58] Field of Search ..... 273/73 R, 73 C, 73 D, 273/73 E, 73 G, 73 H

[56] References Cited

U.S. PATENT DOCUMENTS

| | | | |
|---|---|---|---|
| D. 230,753 | 3/1974 | Vaughn et al. | 273/73 G X |
| 346,751 | 8/1886 | Hillman | 273/73 E |
| 2,171,223 | 8/1939 | Robinson | 273/73 H |

FOREIGN PATENT DOCUMENTS

| | | | |
|---|---|---|---|
| 736167 | 9/1932 | France | 273/73 G |
| 5034 of | 1883 | United Kingdom | 273/73 E |
| 8112 of | 1884 | United Kingdom | 273/73 H |
| 12753 of | 1886 | United Kingdom | 273/73 E |

OTHER PUBLICATIONS

"The Sporting Goods Dealer;" May 1975; p. 143.

*Primary Examiner*—Richard J. Apley
*Attorney, Agent, or Firm*—Sughrue, Rothwell, Mion, Zinn and Macpeak

[57] ABSTRACT

Tennis racket with the racket head built up by crossing strings fastened to a frame, one set of which strings runs substantially in the longitudinal direction of the racket head and a second set of which runs substantially in the transverse direction thereof. In order to reduce the effect of unclean hits the active length of at least the longitudinal strings of a longitudinal center portion of the racket head is greater the farther away from the longitudinal center line of the racket head they are placed.

9 Claims, 1 Drawing Figure

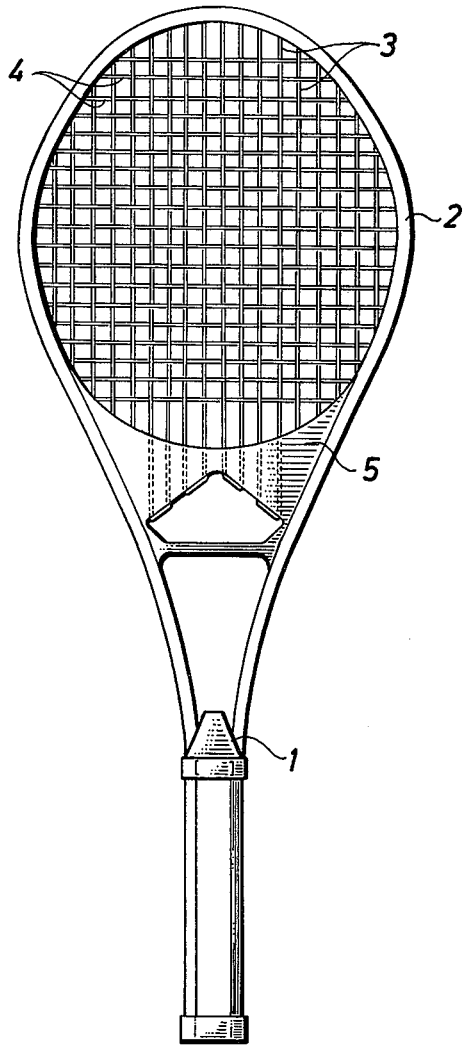
4
3
2
5
1

RACKET

This invention relates to rackets having their racket heads built up by crossing strings fastened to a frame, one set of which strings runs substantially in the longitudinal direction of the racket head and a second set of which runs substantially in the transverse direction thereof, for example tennis rackets.

On a conventional tennis racket the longitudinal strings are shorter the farther away from the longitudinal centre line of the racket head they are placed. Such a racket is among other things relatively sensitive to such an unclean hit at which the ball strikes the playing surface between its centre, the sweet spot, and its limit at the racket throat, and especially if the ball hits the racket on either side of the longitudinal centre line. This sensitivity to unclean hits is due to the facts that the springing characteristic of the playing surface will be continually worse the closer to the fastening points of the strings at the frame the hit takes place and that the transverse strings have a shorter active length the closer to the racket throat they are placed.

Through for instance the drawings of the French patent specification No. 2 195 163 and the U.S. Pat. Nos. 1,684,449 and 2,171,223 it seems to be known to make a tennis racket in such a way that the active length of at least the longitudinal strings of a longitudinal centre portion of the racket head is substantially constant. However, this does not result in any appreciable compensation for the above effects which are not even mentioned in said specifications. The objects of these prior art inventions have not been to reduce the effect of unclean hits by using lengthened strings, which is clear for instance by last mentioned U.S. Pat. No. 2,171,223 in which it is stated that the effect desired according to said patent is obtained by means of spring bridges arched upward as well as downward, see for instance FIGS. 12 and 15 and the corresponding text.

A main object of the present invention is to obtain a racket of the above mentioned kind which is so designed that the effect of an unclean hit, especially in the portion of the playing surface close to the racket throat, is reduced to a great extent.

According to the invention this is obtained by making the active length of at least the longitudinal strings of a longitudinal centre portion of the racket head greater the farther away from the longitudinal centre line of the racket head they are placed.

In a preferred embodiment the ends adjacent to the racket throat of the longitudinal strings of said centre portion are fastened to a throat piece of such a shape that the active length of said strings is greater the farther away from the longitudinal centre line of the racket head they are placed. Preferably, the throat piece is provided with through bores for receiving said longitudinal strings the diameter of which bores permits the strings to run substantially unobstructedly therethrough.

The improved springing capability of the longitudinal strings obtained according to the invention will compensate for the increasing rigidity of the shorter transverse strings adjacent to the racket throat. Further, a hit below the centre of such a racket will hit the longitudinal strings at a greater distance from their fastening points at the frame than would be the case at a conventional racket.

The invention will be described in greater detail below with reference to an embodiment of a racket according to the invention illustrated on the accompanying drawing.

The tennis racket of the drawing comprises a handle 1 which is transformed into a frame 2 to which crossing strings 3 and 4 are fastened for the formation of two identical playing surfaces.

In this embodiment said playing surfaces are limited towards the racket throat by a throat piece 5 which is provided with through bores for the longitudinal strings 3 which bores have such a diameter that the strings run substantially unobstructedly through the bores. The fastening points of the longitudinal strings of a longitudinal centre portion of the racket head are arranged at the arched rear surface of said throat piece 5. The remaining longitudinal strings 3 pass via aligned bores in the throat piece and the frame 2 or they can be fastened to the arched front surface of the throat piece.

By means of the arched rear surface of the throat piece 5 according to this embodiment the longitudinal strings 3 on either side of the two strings in the middle have a successively greater active length the farther away from said centre strings they are placed, the active length being the free and laterally unrestrained length which is able to "give" or vibrate in response to the impact of a ball. In the drawing, for example, the active lengths of the center strings would extend down to the points 6 at the ends of the throat piece bores. In contrast, the active lengths of the outer longitudinal strings would terminate at the entrances 7 of their stringing bores. This results in that the effect of the transverse strings 4 being shorter and thus more rigid the closer to the racket throat they are placed will be reduced dependent upon the improved springing capability of the longitudinal strings 3. The effect of this will be evident when the ball hits the racket below its centre and especially when the ball hits the playing surface on either side of the longitudinal centre line thereof.

Although in the above disclosed embodiment only the longitudinal strings of a longitudinal centre portion of the playing surface have a greater length the farther away from the longitudinal centre line of the playing surface they are placed it is realized that this also can be applied as regards the remaining longitudinal strings. However, this needs a certain redesign of the throat portion of the racket. Further, the extent of said lengthening may be chosen as desired and for instance in connection with metal rackets it might be very great in view of the spacious room that easily is obtainable in connection with such rackets. If desired a corresponding lengthening of the longitudinal strings may also be obtained at the upper end of the racket.

The throat piece of the described embodiment is provided with through bores having such a diameter that the strings will run substantially unobstructedly therethrough. However, said throat piece may also be so designed that the strings may be fastened directly to the surface thereof facing the playing surfaces, provided said surface of the throat piece is convex.

The expression used above and in the claims that the length of longitudinal strings are greater the farther away from the longitudinal centre line of the racket head they are placed is intended also to cover the case at which the strings are considered in groups of two in which case the successively lengthening of the strings takes place between each pair only.

What is claimed is:

1. In a game racket including a racket head comprising an open, substantially oval frame member, a first set of strings strung to the frame member and running substantially in the longitudinal direction of the racket head, and a second set of strings strung to the frame member and running substantially in the transverse direction of the racket head across the longitudinal strings, the improvement characterized by:

means embodied in the frame member for mounting one end of each of a plurality of adjacent ones of the longitudinal strings of the first set in a center portion of the racket head in such a manner that they have free and laterally unrestrained active lengths which successively increase the farther away they are displaced from the longitudinal center line of the racket head, said mounting means having a plurality of spaced through bores for receiving said plurality of adjacent longitudinal strings, the diameter of said bores being sufficiently larger than the diameter of said strings to permit the strings to run substantially unobstructedly therethrough, whereby such successively increasing active lengths compensate for the decreasing active lengths of the transverse strings as they approach the handle end of the racket head, thereby providing an enlarged sweet spot.

2. A game racket as defined in claim 1, wherein:

(a) the mounting means includes a throat piece adjacent a handle end of the racket head, (b) the ends of the longitudinal strings of the center portion are fastened to the throat piece, and (c) the throat piece is shaped to implement the successive increases in the active lengths of the longitudinal strings of the center portion the greater their distance from the longitudinal center line of the racket head.

3. A game racket as defined in claim 2, wherein said through bores are provided in the throat piece.

4. A game racket as defined in claim 3, wherein the throat piece has an inverted V-shape at its surface at which the ends of the longitudinal strings lie.

5. A game racket as defined in claim 4, wherein the second set of strings terminate short of the throat piece to leave the lower portion of the longitudinal strings free from any transverse crossing strings.

6. A game racket as defined in claim 3, wherein the second set of strings terminate short of the throat piece to leave the lower portion of the longitudinal strings free from any transverse crossing strings.

7. A game racket as defined in claim 2, wherein the throat piece has an inverted V-shape at its surface at which the ends of the longitudinal strings lie.

8. A game racket as defined in claim 7, wherein the second set of strings terminate short of the throat piece to leave the lower portion of the longitudinal strings free from any transverse crossing strings.

9. A game racket as defined in claim 2, wherein the second set of strings terminate short of the throat piece to leave the lower portion of the longitudinal strings free from any transverse crossing strings.

* * * * *